US010081991B2

(12) United States Patent
Amezaga et al.

(10) Patent No.: US 10,081,991 B2
(45) Date of Patent: Sep. 25, 2018

(54) MODULAR ADAPTER FOR TONGS

(71) Applicant: Weatherford Technology Holdings, LLC, Houston, TX (US)

(72) Inventors: Federico Amezaga, Cypress, TX (US); Martin Helms, Burgdorf (DE); Martin Liess, Seelze (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 499 days.

(21) Appl. No.: 14/683,391

(22) Filed: Apr. 10, 2015

(65) Prior Publication Data

US 2016/0123094 A1 May 5, 2016

Related U.S. Application Data

(60) Provisional application No. 62/075,461, filed on Nov. 5, 2014.

(51) Int. Cl.
*E21B 19/16* (2006.01)
*F16C 29/00* (2006.01)

(52) U.S. Cl.
CPC ..... *E21B 19/161* (2013.01); *E21B 19/165* (2013.01)

(58) Field of Classification Search
CPC ..... F16C 29/00–29/126; E21B 19/16–19/168
USPC ..... 166/380; 29/428; 81/57.34
See application file for complete search history.

(56) References Cited

U.S. PATENT DOCUMENTS

| | | | | |
|---|---|---|---|---|
| 3,799,009 | A * | 3/1974 | Guier | E21B 19/164 81/57.16 |
| 6,142,041 | A | 11/2000 | Buck | |
| 6,318,214 | B1 | 11/2001 | Buck | |
| 6,412,553 | B1 | 7/2002 | Akerlund | |
| 7,188,547 | B1 | 3/2007 | West et al. | |
| 7,225,865 | B2 | 6/2007 | Akerlund | |
| 7,281,451 | B2 | 10/2007 | Schulze Beckinghausen | |
| 7,413,398 | B2 | 8/2008 | Bangert et al. | |
| 7,455,128 | B2 | 11/2008 | Belik | |
| 7,841,415 | B2 | 11/2010 | Winter | |
| 7,921,750 | B2 | 4/2011 | Pietras | |

(Continued)

FOREIGN PATENT DOCUMENTS

| | | | | |
|---|---|---|---|---|
| SE | 1614915 | A2 * | 1/2006 | F16C 39/02 |
| WO | 2007/142535 | A1 | 12/2007 | |

OTHER PUBLICATIONS

PCT International Search Report and Written Opinion dated Apr. 11, 2016, for International Patent Application No. PCT/US2015/056542.

(Continued)

*Primary Examiner* — George S Gray
(74) *Attorney, Agent, or Firm* — Patterson + Sheridan, LLP

(57) ABSTRACT

A portable tong system includes: a power tong; a backup tong; and an adapter. The adapter includes: a main frame having a base for mounting the backup tong; a mount for mounting the main frame to a positioning system; a leveling frame for torsional connection to the power tong; a suspension mounted to the leveling frame for supporting the power tong; a linear actuator for raising and lowering the leveling frame relative to the main frame; and a torsional arrestor torsionally connecting the leveling frame to the main frame.

18 Claims, 10 Drawing Sheets

(56) References Cited

U.S. PATENT DOCUMENTS

| | | | | |
|---|---|---|---|---|
| 2004/0195555 | A1* | 10/2004 | Bangert | E21B 19/165 254/418 |
| 2005/0061112 | A1 | 3/2005 | Liess | |
| 2009/0065189 | A1 | 3/2009 | Hobgood | |
| 2011/0120730 | A1 | 5/2011 | Clasen et al. | |

OTHER PUBLICATIONS

National Oilwell Varco—"HydraTong ARN-200," http://nov.com/Segments/Rig_Systems/Offshore/Iron_Roughnecks/HydraTong_ARN_200 . . . , 2015, 3 pages.
National Oilwell Varco—"HydraTong ARN-270," http://nov.com/Segments/Rig_Systems/Offshore/Iron_Roughnecks/HydraTong_ARN_2 . . . , 2015, 3 pages.
Weatherford—"MiniScope Tong Positioning System" brochure, 2008, 4 pages.
Weatherford—"PowerArm 2.1 Positioning Device for TorkWrench Iron Roughneck" brochure, 2011, 1 page.
Weatherford—"PowerFrame II Tong-Positioning System" brochure, 2005, 1 page.
Weatherford—"PowerFrame III Tong-Positioning System" brochure, 2006, 4 pages.
Weatherford—"TorkWrench 10-100 Iron Roughneck" brochure, 2008, 8 pages.

* cited by examiner

MODULAR ADAPTER FOR TONGS

BACKGROUND OF THE DISCLOSURE

Field of the Disclosure

The present disclosure generally relates to a modular adapter for tongs.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a drilling rig. After drilling to a predetermined depth, the drill string and drill bit are removed and a string of casing is lowered into the wellbore. An annulus is thus formed between the casing string and the wellbore. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

A tong set is used to tighten threaded connections between a stand of drill pipe and the drill string or between a joint of casing and the casing string. The tong set includes a power tong and a backup tong. The wrenching tong supplies torque to and rotates the stand or joint being added to the drill or casing string while a backup tong torsionally arrests the string, thereby tightening the threaded connection. The tong set may also be used to assemble production tubing and riser strings.

Due to different rig floor sizes (compact style), configurations and limited availability of positioning systems for tongs to make up and break out pipe joints, it is not always possible to accommodate equipment on the rig floor. This is especially true for deep water wells where heavier and longer strings are run, such as twenty-inch or greater casing sizes. These heavier and longer pipe strings require heavy duty equipment which tends to be bulky. Also, compatibility issues arise between tongs and positioning systems built by different manufacturers due to their limited weight/moment capacity and space to accommodate heavy weight tongs.

SUMMARY OF THE DISCLOSURE

The present disclosure generally relates to a modular adapter for tongs. In one embodiment, a portable tong system includes: a power tong; a backup tong; and an adapter. The adapter includes: a main frame having a base for mounting the backup tong; a mount for mounting the main frame to a positioning system; a leveling frame for torsional connection to the power tong; a suspension mounted to the leveling frame for supporting the power tong; a linear actuator for raising and lowering the leveling frame relative to the main frame; and a torsional arrestor torsionally connecting the leveling frame to the main frame.

In another embodiment, a portable tong system includes: a power tong; a backup tong; and an adapter. The adapter includes: a main frame having a base for mounting the backup tong; a mount for mounting the main frame to a positioning system; and a leveling frame for receiving the power tong and linked to the main frame. The system further includes: a skid; and the positioning system for horizontally moving the tongs and the adapter along the skid.

In another embodiment, a method of adapting tongs to a positioning system includes: mounting a backup tong to an adapter; suspending a power tong from the adapter; torsionally connecting the power tong to the adapter; hoisting the adapter and the tongs adjacent to a positioning system located on a floor of a drilling rig; and fastening the adapter to the positioning system.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
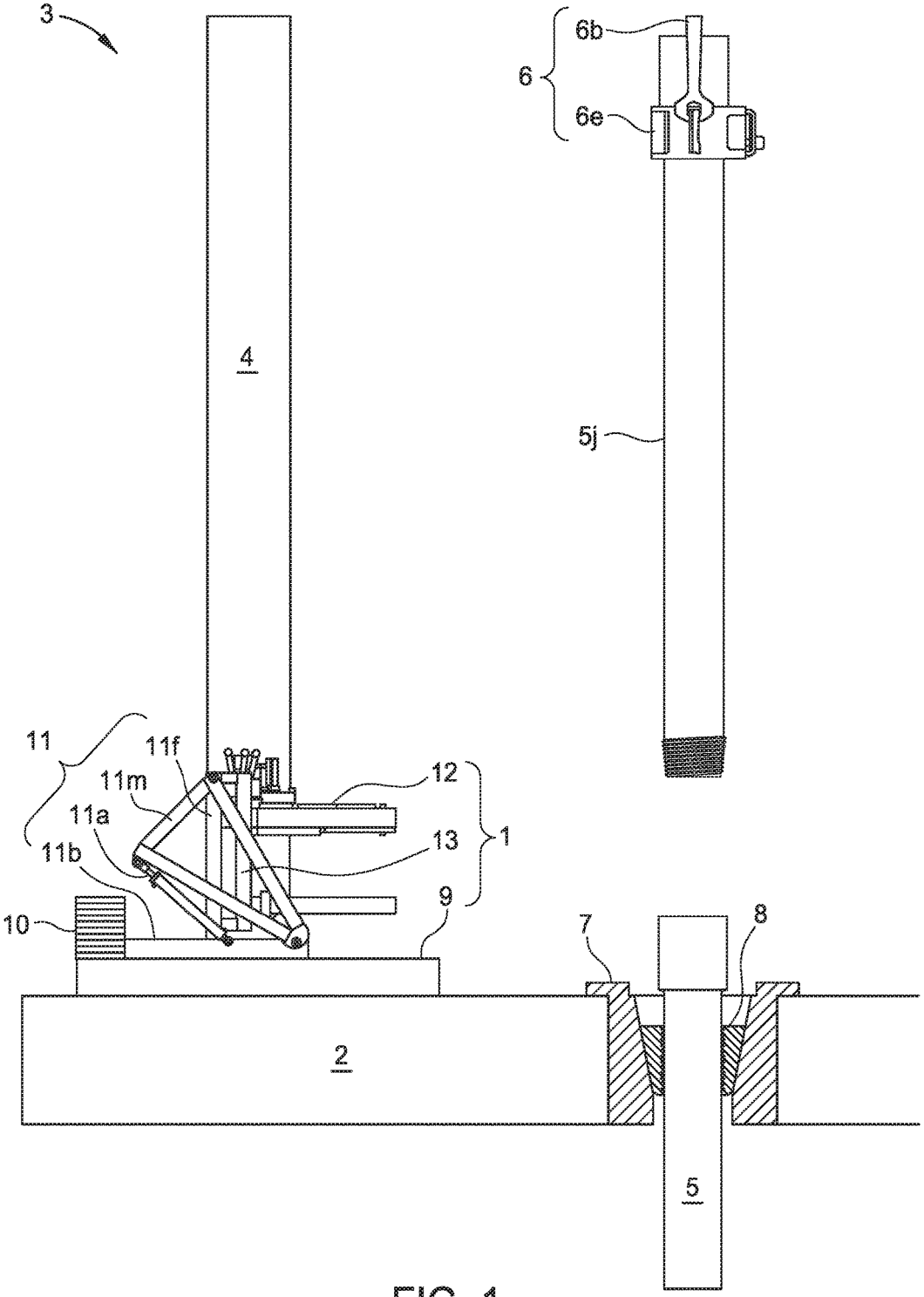
FIG. 1 illustrates a portable tong system in a standby mode, according to one embodiment of the present disclosure.

FIG. 1 illustrates a portable tong system 1 in a standby mode, according to one embodiment of the present disclosure. The portable tong system 1 may be delivered to a floor 2 of a drilling rig 3 when needed, such as by a forklift (not shown), crane (not shown), or pallet jack (not shown), and removed from the rig floor and stowed when not needed so as to not clutter the rig floor. The drilling rig 1 may be part of an offshore drilling system further including a fluid handling system (not shown), marine riser (not shown), a blowout preventer stack (BOP not shown), and a drill string (not shown). The drilling rig 3 may further include a derrick 4 extending upward from the rig floor 2, a top drive (not shown), and a hoist (not shown). The rig floor 2 may have an opening through which the drill string or casing string 5 extends downwardly through the marine riser and BOP and into a subsea wellbore (not shown).

The drilling rig 3 may further include a rail (not shown) extending from the rig floor 2 or lower portion of the derrick 4 toward a crown block (not shown) of the hoist. The top drive may include a becket, a frame, a motor, an inlet, a gear box, a swivel, a quill, a trolley, a pipe handler 6, and a backup wrench. The top drive motor may be electric or hydraulic and have a rotor and a stator. The top drive motor may be operable to rotate the rotor relative to the stator which may also torsionally drive the quill via one or more gears (not shown) of the gear box. The quill may have a coupling (not shown), such as splines, formed at an upper end thereof and torsionally connecting the quill to a mating coupling of one of the gears. Housings of the motor, swivel, gear box, and backup wrench may be connected to the frame and the trolley may connect the frame to the rail. The top drive may further include an interface (not shown) for receiving power and/or control lines.

The trolley may ride along the rail, thereby torsionally restraining the frame while allowing vertical movement of the top drive with a travelling block of the rig hoist. The traveling block may be supported by wire rope connected at its upper end to the crown block. The wire rope may be woven through sheaves of the travelling and crown blocks and extend to drawworks (not shown) for reeling thereof, thereby raising or lowering the traveling block relative to the derrick 4. The becket may connect the traveling block to the frame to suspend the top drive from the crown block. The swivel may include one or more bearings (not shown) for longitudinally and radially supporting rotation of the quill relative to the frame. The inlet may have a coupling for connection to a mud hose (not shown) and provide fluid communication between the mud hose and a bore of the quill. The quill may have a coupling, such as a threaded pin, formed at a lower end thereof for connection to a mating coupling, such as a threaded box, of the drill string.

The pipe handler 6 may include an elevator 6*e*, a pair (only one shown) of bails 6*b*, and a link tilt (not shown). Each bail 6*b* may have an eyelet formed at each longitudinal end thereof. An upper eyelet of each bail 6*b* may be received by a respective lifting lug of the top drive frame, thereby pivotally connecting the bails to the top drive. A lower eyelet of each bail 6*b* may be received by a respective lifting lug of the elevator 6*e*, thereby pivotally connecting the bails to the elevator. The link tilt may include a pair of piston and cylinder assemblies for swinging the elevator 6*e* relative to the top drive frame. An upper hinge knuckle of each piston and cylinder assembly may be received by a respective mating hinge knuckle of the top drive frame, thereby pivotally connecting the piston and cylinder assemblies to the top drive. A lower hinge knuckle of each piston and cylinder assembly may be received by a mating hinge knuckle of the respective bail 6*b*, thereby pivotally connecting the piston and cylinder assemblies to the bails.

The elevator 6*e* may be a casing elevator for running the casing string 5 into the subsea wellbore. When drilling the subsea wellbore or running a work string of drill pipe, a drill pipe elevator (not shown) may be connected to the bails 6*b* instead of the casing elevator 6*e*. The drilling rig 3 may further include a rotary table 7 and a spider 8. The spider 8 may be installed into the rotary table 7 to longitudinally support the casing string 5 from the rig floor 2.

The portable tong system 1 may include a skid 9, a counterweight 10, a positioning system 11, a tong set 12, an adapter 13, and a control system (not shown). The control system may include a hydraulic power unit (HPU, not shown) and a control console (not shown) for operation of the positioning system 11 by a technician. The control system may be mounted to the skid 9. The counterweight 10 may be received by one or more posts (not shown) mounted to the skid 9. The positioning system 11 may include a base 11*b*, a tool frame 11*f*, a boom 11*m*, and a boom actuator 11*a*. The positioning system 11 may be capable of supporting a weight of the tong set 12 without additional external assistance, such as a winch connected to the derrick 4.

Figure 7:
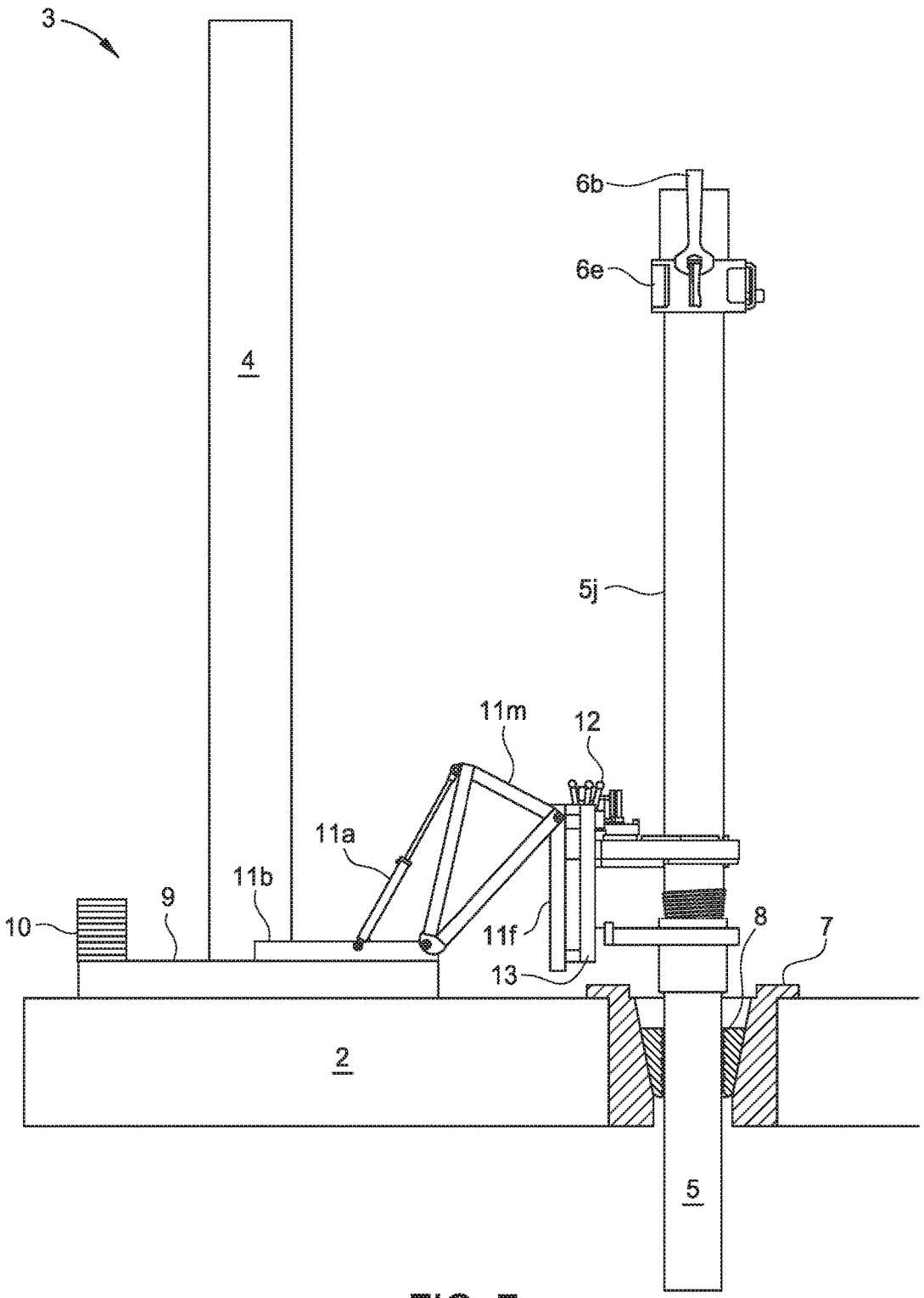
FIG. 7 illustrates operation of a positioning system of the portable tong system to engage the tong set with a casing string and a casing joint stabbed therein.

The base 11*b* may be supported by and longitudinally movable relative to the skid 9, by having sliders (not shown) engaged with rails (not shown) of the skid. The positioning system 11 may further include a base actuator (not shown), such as a piston and cylinder assembly, pivotally connected to the skid 9 and the base 11*b* for moving the base along the skid between a stowed position (shown) and a ready position (FIG. 7). The boom 11*m* may be pivotally connected to the base 11*b*, such as by hinges (only one shown). The boom 11*m* may include a pair of A-frames and one or more girders connecting the A-frames. The boom actuator 11*a* may include one or more, such as a pair, of piston and cylinder assemblies (only one shown). The boom actuator 11*a* may have a first end pivotally connected to the base 11*b*, such as by a hinge, and a second end pivotally connected to the boom 11*m*, such as by a hinge. The boom actuator 11*a* may be operated to pivot the boom 11*m* about the base 11*b* between a retracted position (shown) and an extended position (FIG. 7). The tool frame 11*f* may be pivotally connected to the boom 11*m*, such as by a hinge. The tool frame 11*f* may also be pivotally connected to the base 11*b* by a stabilizer (not shown) such that a longitudinal axis of the tool frame remains vertically oriented as the boom 11*m* moves between the extended and retracted positions.

Alternatively, the base 11*b* may include a turntable and turntable actuator such that the boom 11*m* may slew relative to the skid 9. Alternatively, the tool frame 11*f* may include a dolly and a dolly actuator to raise and lower the tong set 12 and adapter 13 relative to the boom 11*m*. Alternatively, the skid 9 may be secured to the rig floor 2 or derrick 4 to obviate the need for a counterweight 10.

Figure 2:
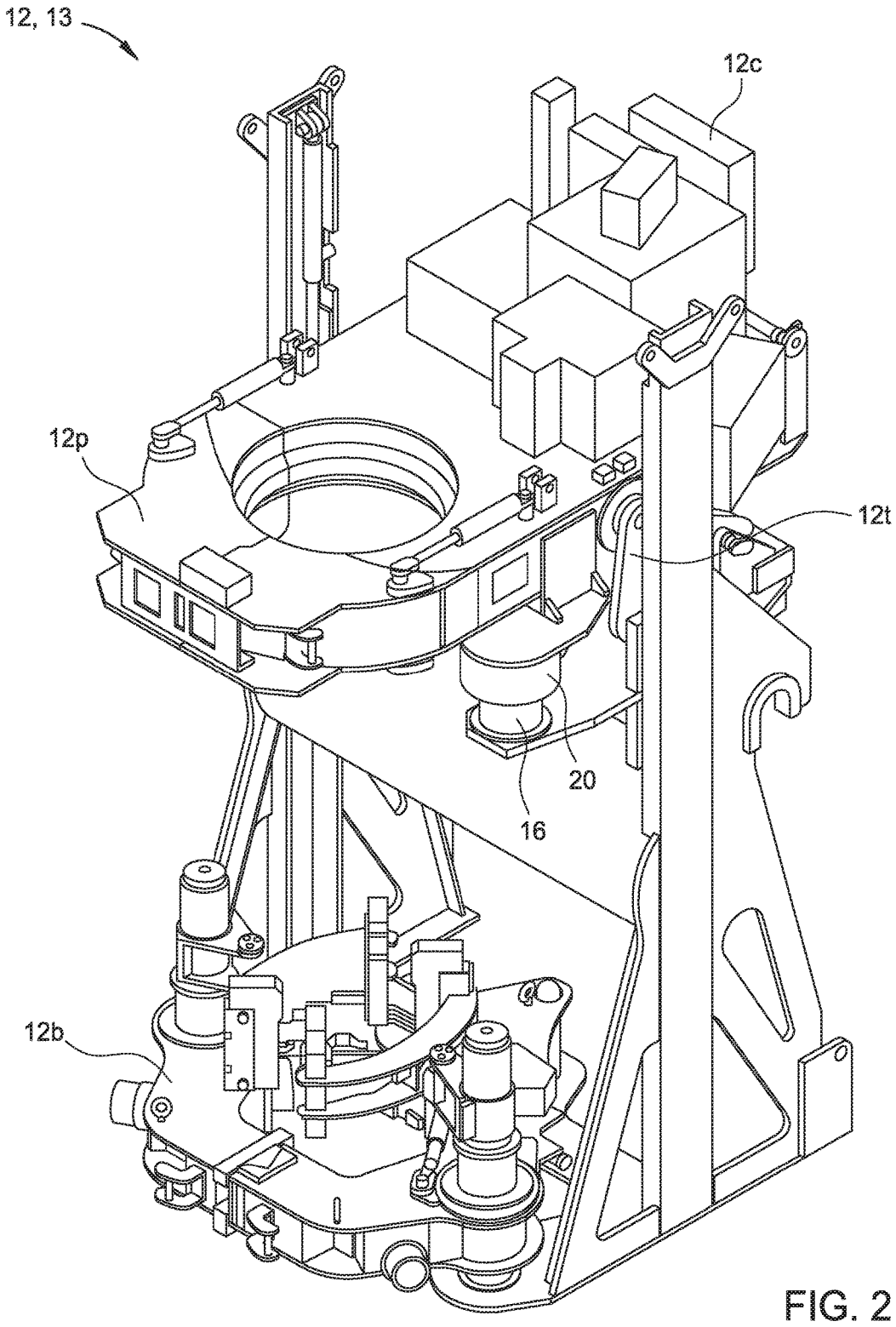
FIGS. 2, 3A, and 3B illustrate a tong set and an adapter of the portable tong system.
Figure 3A:
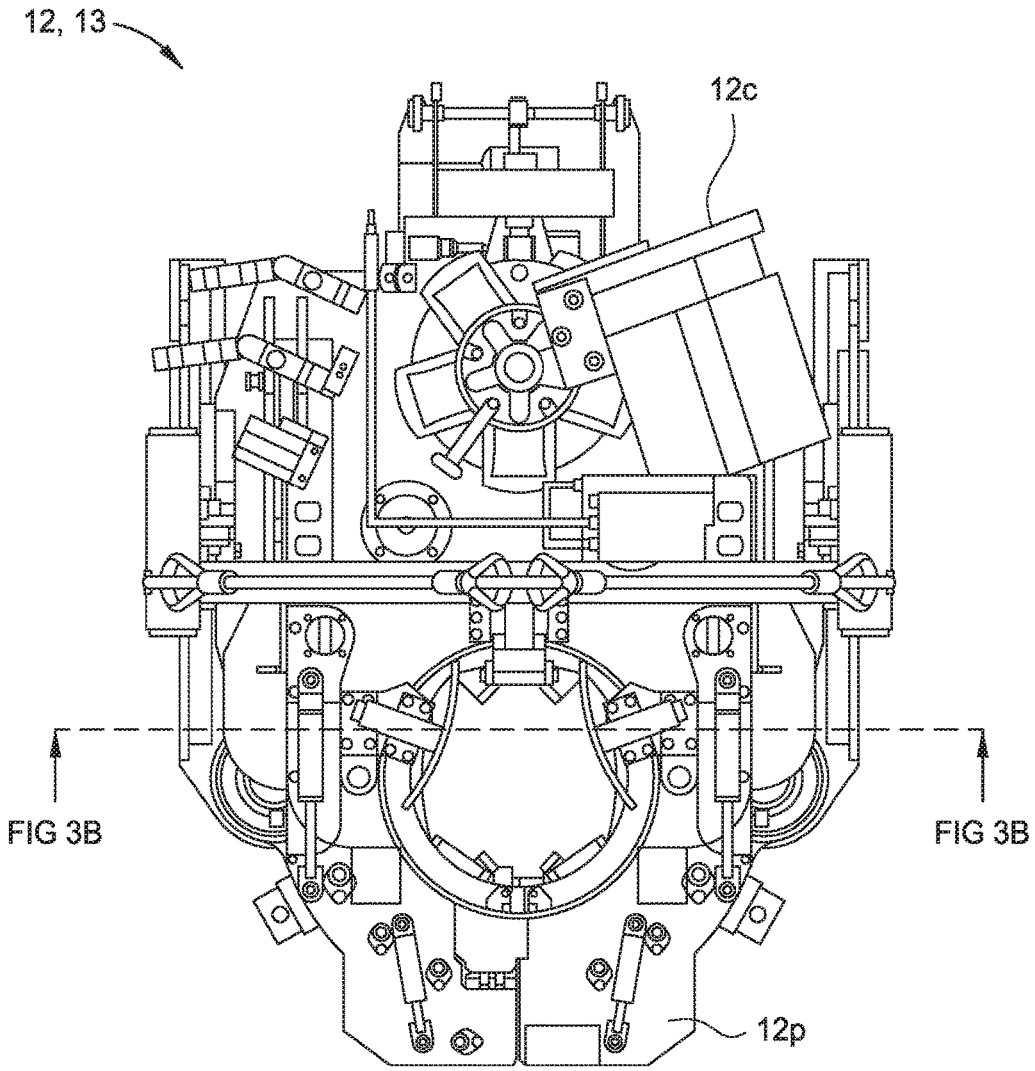
Figure 3B:
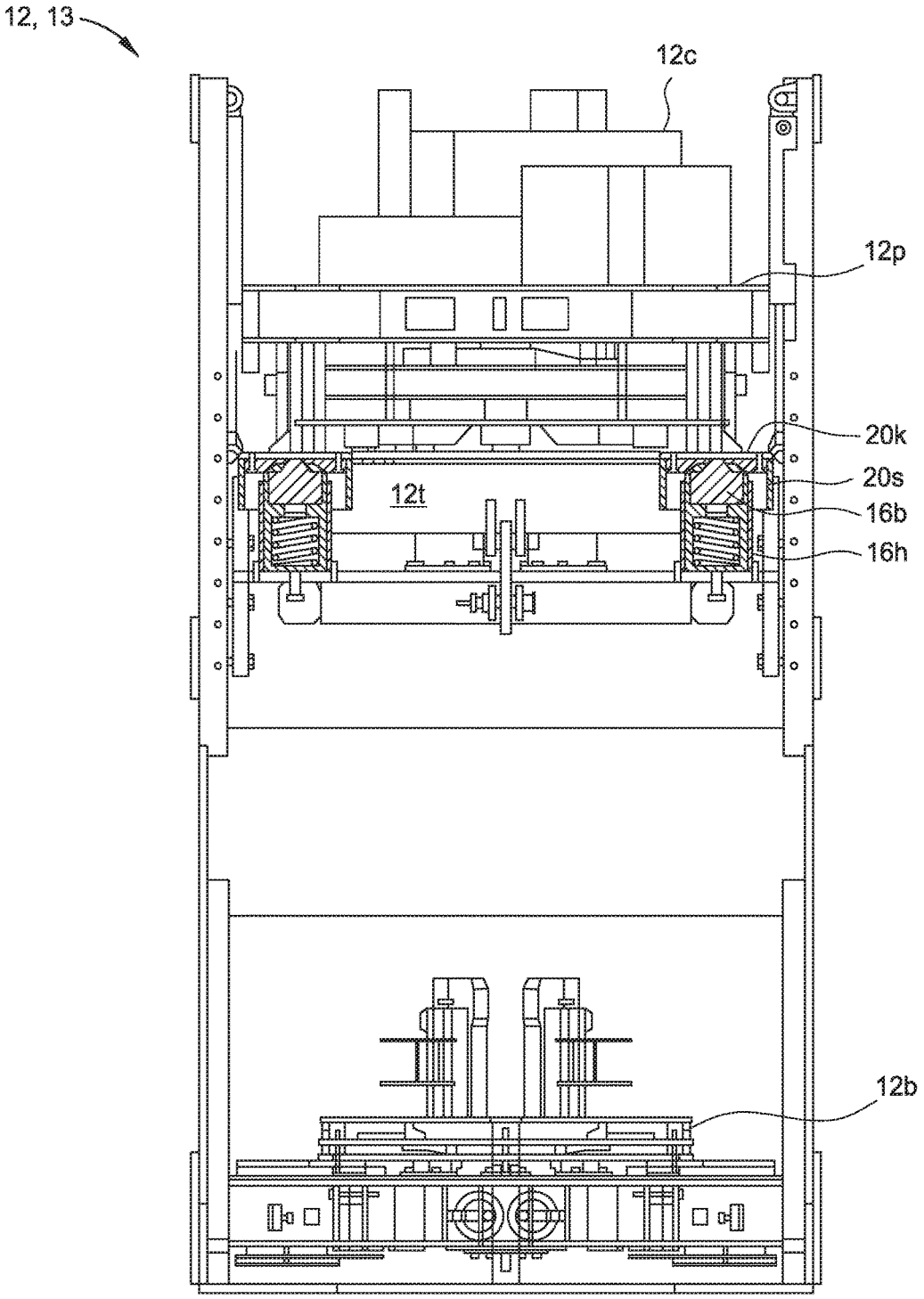

FIGS. 2, 3A, and 3B illustrate the tong set 12 and the adapter 13. The tong set 12 may include a power tong 12*p*, a backup tong 12*b*, a torsion tube 12*t*, and a control system 12*c*. The control system 12*c* may include an HPU and a control console for operation of the tong set 12 by a technician. The control system 12*c* may be mounted to the power tong 12*p*.

Each tong 12*b,p* may include a body and a pair of segments pivotally connected to the body. The segments and body may define a cylindrical opening. The segments may be pivoted about the body between an open position (not shown) and a closed position (shown). In the open position, the segments may be pivoted outward to create a passage for receiving the respective casing joint 5*j* and casing string 5 into the respective openings. Once received, the tongs 12*b,p* may be moved to the closed position for screwing the casing joint 5*j* into the casing string 5. Each tong 12*b,p* may include a segment actuator, such as a piston and cylinder assembly, pivotally connected to the respective body and the respective segment. Each segment may include a portion of a gate having a male member and a female member and the gate may be formed when the segments are in the closed position.

The power tong 12*p* may include a pinion motor, a segmented rotary gear, two or more, such as three, jaws, a jaw actuator for each jaw, and support members disposed between the jaws. The support members may be fixed within the inner diameter of the rotary gear such that the jaws and the support members rotate with the rotary gear. The jaws may be radially movable relative to the rotary gear between a gripping position and a released position. A spring may bias each jaw toward the released position. Each jaw actuator may include one or more, such as a pair, of pistons operable to push the respective jaw to the gripping position in engagement with an outer surface of the casing joint 5*j*. A rotor of the pinion motor may be meshed with the rotary gear for torsionally driving the jaws. The backup tong 12*p* may have jaws, jaw springs, and jaw actuators similar to the power tong except that the jaw assemblies may be torsionally connected to the body thereof.

Alternatively, the power tong 12*p* may include a plurality, such as three, pinion motors.

The torsion tube 12*t* may extend underneath the body of the power tong 12*p* and have arms attached to ends thereof.

Each arm may be pivotally connected to a respective side of the power tong body for receiving reaction torque from the power tong 12*p*. The torsion tube 12*t* may also have an ear attached thereto at a center thereof. The arms and ear of the torsion tube 12*t* may torsionally connect the power tong 12*p* to the adapter 13.

Figure 4:
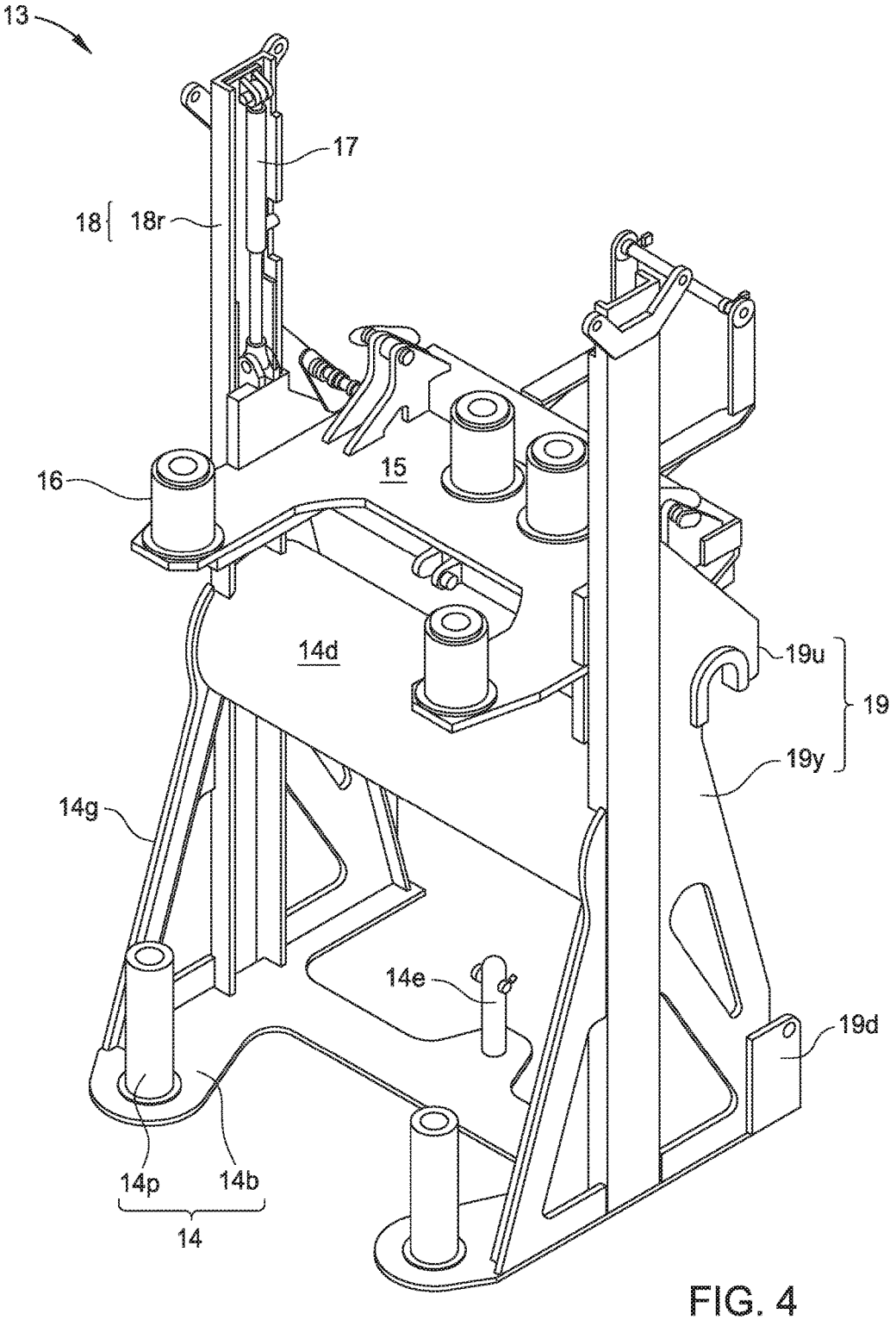
FIGS. 4-6 illustrate the adapter of the portable tong system.
Figure 5:
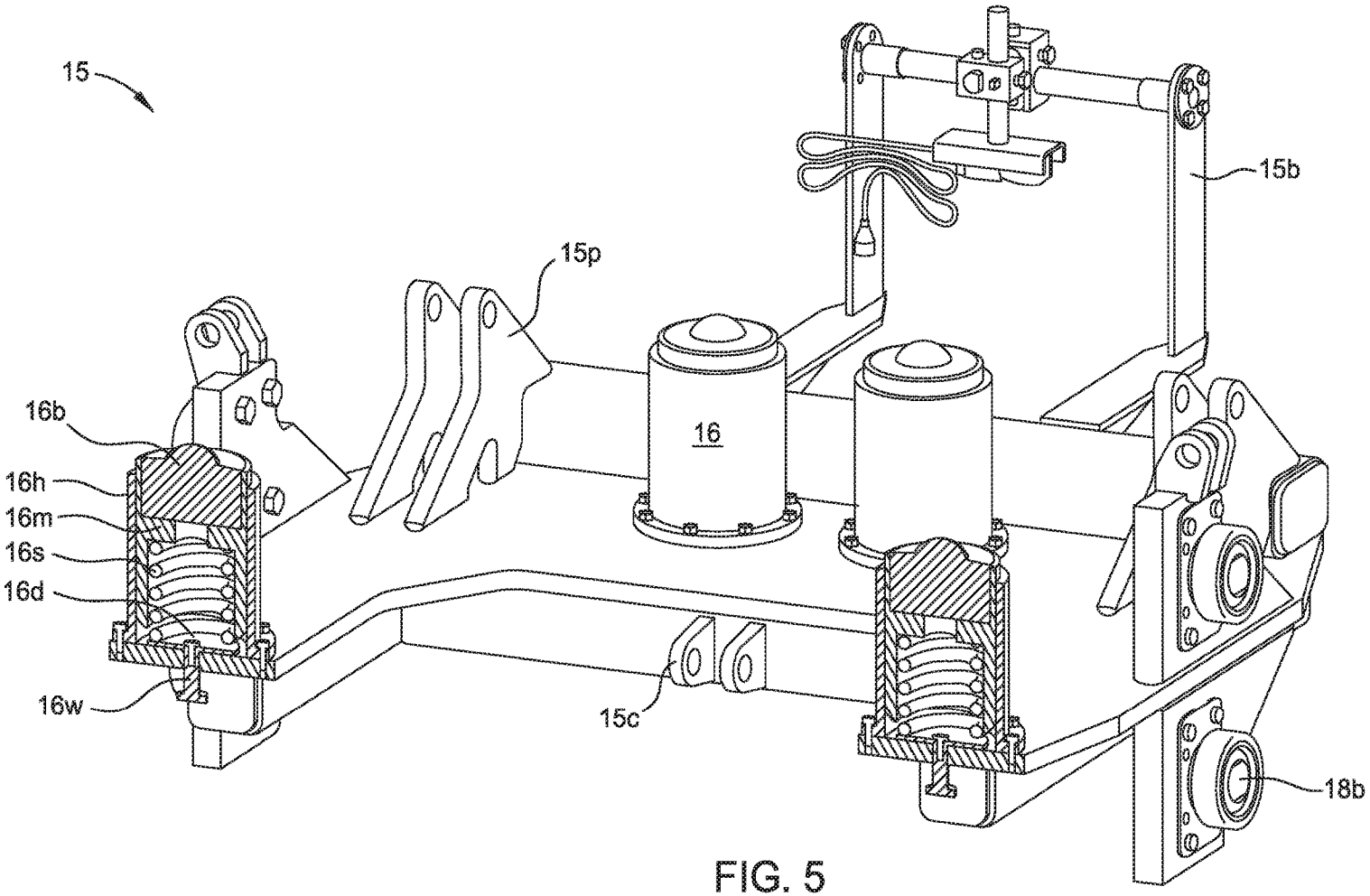
Figure 6:
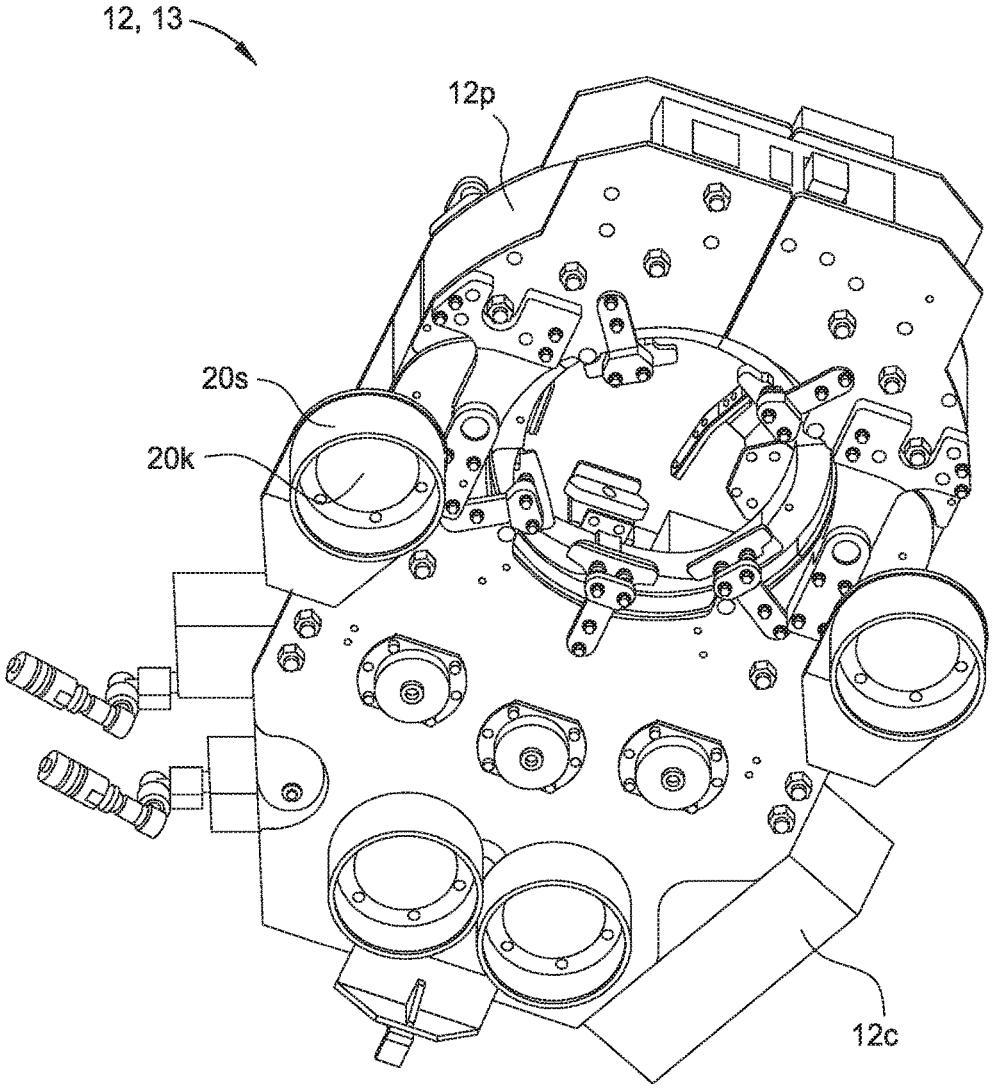

FIGS. 4-6 illustrate the adapter 13. The adapter 13 may include a main frame 14, a leveling frame 15, a suspension 16, 20, a linear actuator 17, a torsional arrestor 18, and a mount 19. The main frame 14 may include a base 14*b*, a girder 14*d*, one or more (pair shown) posts 14*p*, a peg 14*e*, one or more (pair shown) gusset plates 14*g*. The posts 14*p* and pegs 14*e* may extend upward from the base 14*b*, be attached thereto, such as by welds, and may be received into sockets (not shown) of the backup tong 12*b*, thereby torsionally and horizontally connecting the backup tong to the main frame 14 and vertically supporting the backup tong therefrom.

The mount 19 may include one or more (pair shown) bodies 19*y*, one or more (pair shown) upper hangers 19*u*, and one or more (pair shown) lower plates 19*d*. The torsional arrestor 18 may include a pair of rails 18*r* and one or more (pair shown) linear bearings 18*b* disposed in each rail 18*r*. The rails 18*r* may extend upward from the base 14*b* and be attached thereto, such as by welds. The gusset plates 14*g* may be attached to the base 14*b* and the rails 18*r*, such as by welds. The rails 18*r* may also extend through the girder 14*d* and be attached thereto, such as by welds. The girder 14*d* may be attached to the mount bodies 19*y*, such as by welds. The girder 14*d* may be centrally disposed along the rails 18*r* and be disposed between the leveling frame 15 and the base 14*b* which may also be between the power tong 12*p* and the backup tong 12*b*.

The mount bodies 19*y* may also serve as gusset plates and may be attached to the base 14*b* and the rails 18*r*, such as by welds. The upper hangers 19*u* may be hooks formed in the mount bodies 19*y* and lined with plate attached thereto, such as by welds, and the lower plates 19*d* may be attached to the bodies 19*y*, such as by welds. The upper hangers 19*u* may engage a crossbar of the tool frame 11*f* and the lower plates 19*d* may have holes for aligning with holes of the tool frame to receive fasteners therethrough, thereby mounting the main frame 14 to the tool frame.

The linear actuator 17 may vertically link the leveling frame 15 to the main frame 14. The linear actuator 17 may include one or more (one fully shown and one partially shown) piston and cylinder assemblies disposed in the rails 18*r*. An upper hinge knuckle of each piston and cylinder assembly may be received by a mating hinge knuckle of the respective rail 18*r*, thereby pivotally connecting the piston and cylinder assemblies to the rails. A lower hinge knuckle of each piston and cylinder assembly may be received by a respective mating hinge knuckle of the leveling frame 15, thereby pivotally connecting the piston and cylinder assemblies to the leveling frame. A stroke length of the linear actuator 17 may correspond to, such as being equal to or slightly greater than, a makeup length of the threaded connection between the casing joint 5*j* and the casing string 5 or the stroke length may be significantly greater the makeup length. In numerical terms, the stroke length of the linear actuator 17 may be greater than or equal to thirty centimeters, sixty centimeters, ninety centimeters, or one meter.

The torsional arrestor 18 may torsionally and horizontally connect the leveling frame 15 to the main frame 14 while allowing vertical movement of the leveling frame relative to the main frame. Each linear bearing 18*b* may include a body fastened to the leveling frame 15 and one or more (pair shown) rollers linearly connected to the body while being free to rotate about a horizontal axis. Each body may include a mounting plate and a bearing stem. One of the rollers may be an outer roller disposed around the bearing stem and free to rotate relative thereto about a first horizontal axis. The other roller may be an inner roller disposed in the bearing stem and free to rotate relative thereto about a second horizontal axis perpendicular to the first horizontal axis. The outer rollers may be fit to a depth of the rails 18*r* such that the outer rollers may engage one flange of the rails when the power tong 12*p* is operated. The inner rollers may engage webs of the rails 18*r*.

The suspension 16, 20 may include two or more (four shown) sliding pillars 16 and a receptacle 20 for each pillar. Each sliding pillar 16 may include a housing 16*h*, a ball stud 16*b*, a compression spring 16*s*, a mandrel 16*m*, an adjustment disk 16*d*, and an adjustment screw 16*w*. The housings 16*h* may be cylindrical and each may have a flange for mounting to the leveling frame 15, such as by threaded fasteners. The mandrels 16*m* may be disposed in the housings 16*h* and may each be longitudinally movable relative thereto. The mandrels 16*m* may each have an upper tube, a lower tube, and a washer connecting the tubes. The adjustment disks 16*d* may each be disposed in a respective housing 16*h* and linked to the leveling frame 15 by the respective adjustment screw 16*w*. The springs 16*s* may each be disposed in the lower tube of the respective mandrel 16*m* and have an upper end pressing against the washer thereof and a lower end pressing against the respective adjustment disk 16*d*, thereby biasing the respective mandrel vertically away from the leveling frame 15. The springs 16*s* may have sufficient stiffness to support weight of the power tong 12*p* and control system 12*c*. The ball studs 16*b* may each have a hemi-spherical upper portion and a cylindrical lower portion disposed in the upper tube of the respective mandrel 16*m*.

Two of the receptacles 20 may be mounted to a bottom of the power tong 12*p* and two of the receptacles may be mounted to a side of the power tong, such as by threaded fasteners. Each receptacle 20 may include a cylindrical shroud 20*s* and a ball socket 20*k*. Each ball socket 20*k* may be disposed in the respective shroud 20*s*. Each ball socket 20*k* may have a hemi-spherical inner seat and an outer flange for receiving the threaded fasteners. Each shroud 20*s* may have an upper lip received in a groove of the respective flange of the ball socket 20*k*, thereby trapping the shrouds between the ball sockets and the power tong 12*p*. Each seat of the ball socket 20*k* may engage the hemi-spherical upper portion of the respective ball stud 16*b* and each shroud 20*s* may receive an upper portion of the respective housing 16*h*. The shrouds 20*s* may have inner diameters greater than outer diameters of the housings 16*h*, thereby forming outer clearances between the shrouds and the housings. The seats of the ball sockets 20*k* may have diameters greater than diameters of the hemi-spherical upper portions of the ball studs 16*b*, thereby forming inner clearances between the ball sockets and the ball studs.

The suspension 16, 20 may vertically support the power tong 12*p* from the leveling frame 15 in a floating fashion while also horizontally linking the power tong to the leveling frame in an articulating fashion. Engagement of tops of the housings 16*h* with the flanges of the ball sockets 20*k* may serve as a limit to the floating of the power tong 12*p* on the leveling frame 15 and the inner and outer clearances may serve as limits to articulation of the power tong 12*p* relative to the leveling frame 15. A travel range of the suspension in each of the vertical and horizontal directions may be greater than or equal to ten millimeters, twenty millimeters, thirty millimeters, or forty millimeters.

Alternatively, the sliding pillars 16 may be mounted to the power tong 12*p* and the receptacles 20 may be mounted to the leveling frame 15.

The leveling frame 15 may have one or more (pair shown) peripheral lugs 15*p* and a central lug 15*c*. The peripheral lugs 15*p* may be connected to the arms of the torsion bar 12*t* and the central lug 15*c* may be connected to the ear of the torsion bar, such as by link arms and threaded fasteners, thereby torsionally connecting the power tong 12*p* to the leveling frame 15. The leveling frame 15 may also have a bracket 15*b* for receiving an electrical power cable for connecting the control system 12*c* to an electrical power source of the drilling rig 3.

FIG. 7 illustrates operation of the positioning system 11 to engage the tong set 12 with the casing string 5 and the casing joint 5*j* stabbed therein. After the casing joint 5*j* is swung into position over the casing string 5 using the pipe handler 6, a bottom coupling of the casing joint may be stabbed into a top coupling of the casing string by operation of the rig hoist. The base actuator of the positioning system 11 may be operated to move the base 11*b* along the skid 9 to the ready position, thereby horizontally transporting the tong set 12 from a position adjacent to the derrick 4 to a position adjacent to the casing string 5. The tong control system 12*c* may then be operated to open the tongs 12*b,p*. The boom actuator 11*a* may then be operated to pivot the boom 11*b* to the extended position so that the top coupling of the casing string 5 is received into the opening of the backup tong 12*b* and a lower portion of the casing joint 5*j* is received into the opening of the power tong 12*p*. The tong control system 12*c* may then be operated to close the tongs 12*b,p* and operate the jaw actuators to move the jaws into gripping engagement with the outer surfaces of the respective casing string 5 and casing joint 5*j*.

Figure 8:
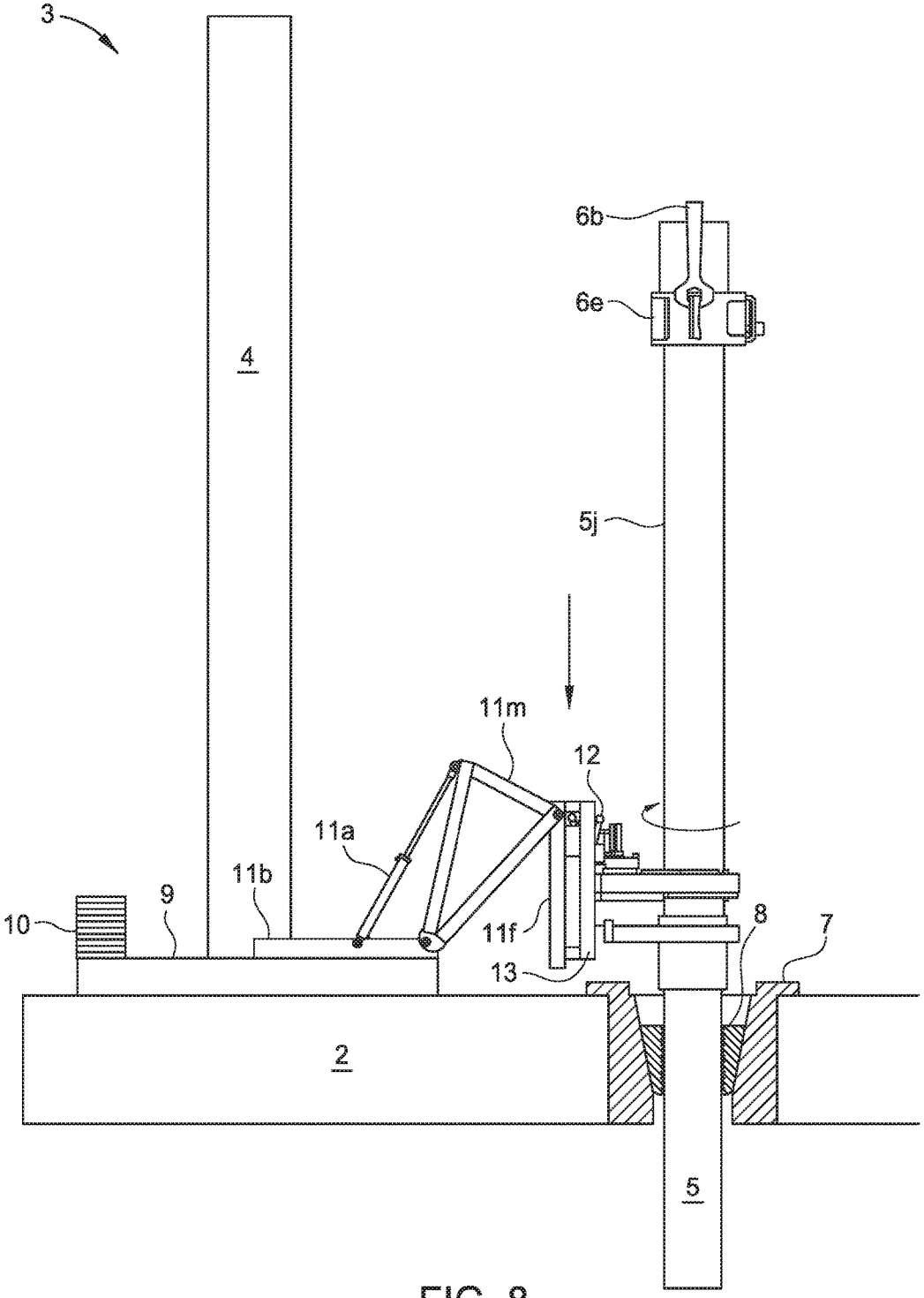
FIG. 8 illustrates operation of a power tong of the tong set to screw the casing joint into the casing string.

FIG. 8 illustrates operation of the power tong 12*p* to screw the casing joint 5*j* into the casing string 5. A pressure regulator of the tong control system 12*c* may be operated to maintain pressure in the linear actuator 17 for exerting an upward force on the leveling frame 15 corresponding to a weight thereof and a weight of the power tong 12*p* and control system 12*c* such that little or no downward force is exerted on the casing joint 5*j* during makeup with the casing string 5 (aka a neutral condition). A thread compensator of the top drive or pipe handler 6 may also be operated to support a weight of the casing joint 5*j* during makeup to also maintain the neutral condition. The linear actuator 17 may be operated with hydraulic fluid, such as refined and/or synthetic oil.

The pinion motor may then be operated to drive the power tong 12*p* to spin and tighten the threaded connection between the casing joint 5*j* and the casing string 5. The pressure regulator may relieve fluid pressure from the linear actuator 17 as the casing joint 5*j* is screwed into the casing string 5 while the linear actuator strokes downward to accommodate longitudinal displacement of the threaded connection. The thread compensator of the top drive or pipe handler 6 may also stroke downward in a similar fashion.

Alternatively, the linear actuator 17 may be pneumatically operated. Alternatively, instead of the top drive or pipe handler 6 having a thread compensator, weight of the casing joint 5*j* may be set onto the power tong 12*p* and the linear actuator 17 operated to support the weight of the casing joint.

Figure 9:
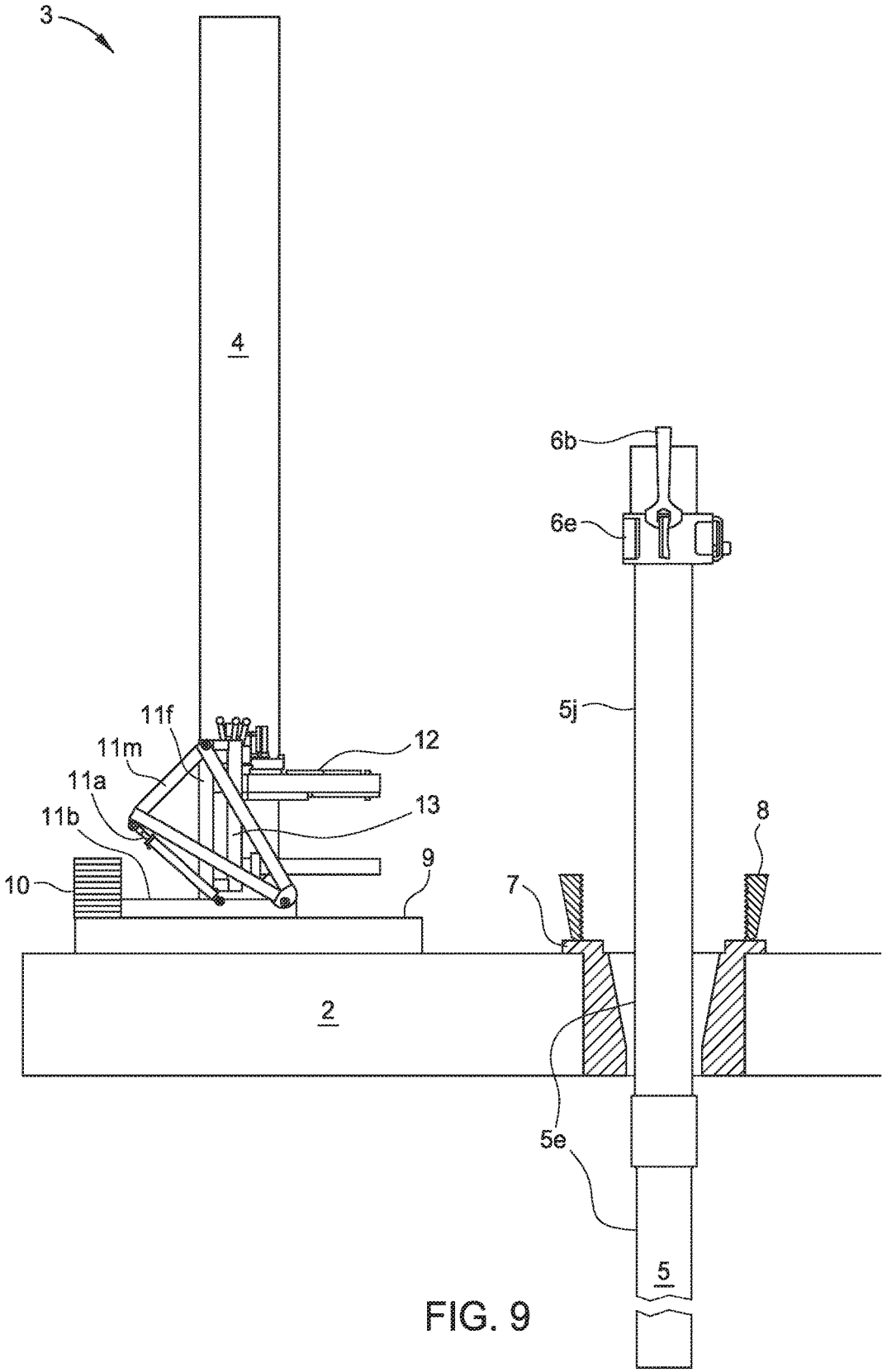
FIG. 9 illustrates running of the extended casing string.

FIG. 9 illustrates running of an extended casing string 5*e*. Once the threaded connection has been madeup, the jaws of the tongs 12*b,p* may be disengaged from the extended casing string 5*e*, the power tong 12*p* raised back to an upper position, the tongs opened, the boom pivoted back to the retracted position, and the base moved back to the stowed position. The rig hoist may be operated to lift the extended casing string 5*e* and the spider 8 may then be disengaged from the extended casing string. The extended casing string 5*e* may then be lowered through the rig floor 2 until the top coupling of the casing joint 5*j* is adjacent thereto and the acts repeated to add another casing joint to the extended casing string.

Alternatively, a seal head of a circulation or flowback tool connected to the quill of the top drive may be stabbed into the casing joint 5*j* before disengaging the spider 8 from the extended casing string 5*e* and/or before lowering the extended casing string through the rig floor 2. Alternatively, a liner string, riser string, conductor string, production tubing string, wellscreen string, work string, or drill string may be assembled or disassembled using the portable tong system 1.

In another embodiment (not shown), but illustrated in the priority U.S. Prov. App. No. 62/075,461, which is herein incorporated by reference in its entirety, at FIGS. 1A-1C, a tong adapter for connecting a heavy weight power tong assembly to an existing tong positioning system of a drilling rig includes vertical displacement capability provided by hydraulic cylinders. The tong adapter has hook connections on top to support the weight of the power tong assembly hung therefrom. Horizontal displacement is provided by the tong positioning system. The tong adapter includes removable support brackets for installation of the power tong assembly. The power tong assembly is installed in the tong adapter before it is placed in the tong positioning system to save time and ease the installation process.

In another embodiment (not shown), but illustrated in FIGS. 2A and 2B of the '461 provisional, a second tong adapter for connecting a heavy weight power tong assembly to an existing tong positioning system of a drilling rig includes a lifting fork for holding the power tong assembly. The second tong adapter includes vertical displacement capability provided by hydraulic cylinders. The second tong adapter includes a rolling frame for transferring the weight of the power tong assembly to the rig floor instead of the tong positioning system to reduce moment exerted thereon. Horizontal displacement is provided by the tong positioning system.

In another embodiment (not shown), but illustrated in FIGS. 3A and 3B of the '461 provisional, a third tong adapter for connecting a heavy weight power tong assembly to an existing tong positioning system of a drilling rig has hook connections on top to support the weight of the power tong assembly hung therefrom. The third tong adapter includes vertical displacement capability provided by hydraulic cylinders. A swing arm connects the hanger to a standing frame and the third tong adapter has horizontal displacement capability provided by hydraulic cylinders. The standing frame has supporting studs for transferring the weight of the power tong assembly to the rig floor instead of the tong positioning system to reduce moment exerted thereon.

The first, second, and third tong adapter embodiments of the '461 provisional have the capability to horizontally and vertically displace heavy weight tong assemblies while utilizing existing tong positioning systems. The modular design allows using the same adapter for different positioning systems with only minor modifications to the connection members.

In another embodiment (not shown), but illustrated in FIGS. 4A-4H of the '461 provisional, a portable heavy weight power tong system is movable between an extended position (FIGS. 4A, 4C, and 4E) and a retracted position (FIGS. 4B, 4D, and 4F). The portable heavy weight power tong system has illustrates support legs extendable (FIG. 4G) and locked in place with locking pins. The support legs are also retractable (FIG. 4H). The portable power tong system does not require an existing tong positioning system of the drilling rig. An adapter of the portable power tong system has vertical and horizontal displacement capability of the power tong assembly provided by hydraulic cylinders. A standing frame of the adapter has supporting studs for transferring the weight of the power tong assembly to the rig floor and has the supporting legs for engaging the rig floor to handle overturning moment. The support legs are extended and retracted using hydraulic or pneumatic cylinders. Counterweight may also be added to the standing frame to handle the overturning moment.

In another embodiment (not shown), but illustrated in FIGS. 5A-5F of the '461 provisional, a second portable heavy weight power tong system is movable between an extended position (FIGS. 5A, 5C, and 5E) and a retracted position (FIGS. 5B, 5D, and 5F). The second portable power tong system does not require an existing tong positioning system of the drilling rig. An adapter of the second portable power tong system includes a standing frame to distribute weight of the power tong assembly to the rig floor. The adapter also includes pivoting bars connected to the power tong assembly driven by hydraulic cylinders to provide horizontal displacement thereof. The adapter also includes a scissor mechanism driven by hydraulic cylinders to provide vertical displacement of the power tong assembly.

In another embodiment (not shown), but illustrated in FIGS. 6A-6C of the '461 provisional, a third portable heavy weight power tong system is movable between an extended position (FIG. 6A) and a retracted position (FIG. 6B). The third portable heavy weight power tong system is also vertically displaceable (FIG. 6C). The third portable power tong system does not require an existing tong positioning system of the drilling rig. An adapter of the third portable power tong system includes a standing frame to distribute weight of the power tong assembly to the rig floor. The adapter also includes a geared racks connected to the power tong assembly driven by pinion motors to provide horizontal displacement thereof. The adapter also includes pivoting cylinders connected to the geared rack to provide vertical displacement of the power tong assembly.

The adapters of the first, second, and third portable power tong systems of the '461 provisional have the ability to vertically and horizontally displace the power tong assemblies in any area close to the well center for pipe make up and break down operations. These adapters eliminate the need to adapt to an existing rig positioning system which could limit the use of heavy weight power tong assemblies.

While the foregoing is directed to embodiments of the present disclosure, other and further embodiments of the disclosure may be devised without departing from the basic scope thereof, and the scope of the invention is determined by the claims that follow.

The invention claimed is:

1. A portable tong system, comprising:
- a power tong;
- a backup tong; and
- an adapter comprising:
  - a main frame having a base for mounting the backup tong;
  - a mount for mounting the main frame to a positioning system;
  - a leveling frame for torsional connection to the power tong, wherein the power tong is disposed on the leveling frame;
- a suspension mounted to an upper surface of the leveling frame for supporting the power tong, wherein the suspension has a member extending upward from an upper surface of the leveling frame;
- a linear actuator for raising and lowering the leveling frame relative to the main frame; and
- a torsional arrestor torsionally connecting the leveling frame to the main frame.

2. The system of claim 1, wherein:
- the torsional arrestor comprises a pair of rails extending upwardly from the base, and
- the main frame further has a girder connected to the rails and disposed between the leveling frame and the base.

3. The system of claim 2, wherein:
- the mount comprises a pair of bodies, a pair of upper hangers, and a pair of lower plates,
- the mount bodies are attached to the rails and the base,
- the pair of upper hangers are coupled to the positioning system, and
- the lower plates have holes for receiving fasteners.

4. The system of claim 2, wherein a stroke length of the linear actuator corresponds to a makeup length of casing joints.

5. The system of claim 4, wherein:
- the linear actuator comprises a pair of piston and cylinder assemblies disposed in the rails, and
- upper ends of the piston and cylinder assemblies are pivotally connected to the rails, and
- lower ends of the piston and cylinder assemblies are pivotally connected to the leveling frame.

6. The system of claim 2, wherein:
- the torsional arrestor further comprises a linear bearing disposed in each rail, and
- each linear bearing is fastened to the leveling frame.

7. The system of claim 6, wherein each linear bearing comprises:
- a body;
- an outer roller disposed around the body and free to rotate relative thereto about a first horizontal axis; and
- an inner roller disposed in the body and free to rotate relative thereto about a second horizontal axis perpendicular to the first horizontal axis.

8. The system of claim 1, wherein the suspension comprises:
- the member comprising two or more sliding pillars mounted to the leveling frame; and a receptacle for each sliding pillar mounted to the power tong.

9. The system of claim 8, wherein each sliding pillar comprises:
- a cylindrical housing having a flange for mounting to the leveling frame;
- a mandrel disposed in the housing;
- a compression spring disposed between the mandrel and the leveling frame; and
- a ball stud disposed in the mandrel.

10. The system of claim 9, wherein each receptacle comprises:

a cylindrical shroud having an inner diameter greater than an outer diameter of the respective housings, thereby forming an outer clearance therebetween; and a ball socket disposed in the shroud and having a seat diameter greater than a ball diameter of the ball stud, thereby forming an inner clearance therebetween.

11. The system of claim 1, wherein a travel range of the suspension in each of the vertical and horizontal directions is greater than or equal to ten millimeters.

12. The system of claim 1, further comprising:

a torsion tube extending underneath a body of the power tong and having arms attached to ends thereof, wherein:

each arm is pivotally connected to a respective side of the power tong body, and the leveling frame has lugs connectable to the arms.

13. The system of claim 1, further comprising:

a control system mounted to the power tong, wherein the leveling frame further has a bracket for receiving an electrical power cable for connecting the control system to an electrical power source.

14. The system of claim 1, further comprising the positioning system for horizontally moving the tongs and the adapter over a rig floor.

15. The system of claim 14, further comprising:

a skid; and a counterweight mounted on the skid to counter a weight of the positioning system, wherein the positioning system is movable along the skid.

16. A method of using the system of claim 14, comprising:

supporting a string of tubular joints from a floor of a drilling rig;

stabbing a tubular joint into the string;

operating the positioning system to move the tongs adjacent to the string;

engaging the power tong with the tubular joint and engaging the backup tong with the string; and operating the power tong to screw the tubular joint into the string while operating the linear actuator to maintain the tubular joint in a neutral condition.

17. A portable tong system, comprising:

a power tong;

a backup tong;

an adapter comprising:

a main frame having a base for mounting the backup tong;

a mount for mounting the main frame to a positioning system;

a leveling frame for receiving the power tong and the leveling frame being linked to the main frame;

a suspension mounted to the leveling frame for supporting the power tong wherein the suspension include:

two or more sliding pillars mounted to the leveling frame; and a receptacle for each sliding pillar mounted to the power tong;

a skid; and the positioning system for horizontally moving the tongs and the adapter along the skid.

18. A method of adapting tongs to a positioning system, comprising:

mounting a backup tong to an adapter;

suspending a power tong on a leveling frame of the adapter using a suspension having a member extending upward from an upper surface of the leveling frame;

torsionally connecting the power tong to the adapter;

hoisting the adapter and the tongs adjacent to the positioning system located on a floor of a drilling rig; and fastening the adapter to the positioning system.

* * * * *